US005258771A

United States Patent [19]

Praba

[11] Patent Number: 5,258,771

[45] Date of Patent: Nov. 2, 1993

[54] INTERLEAVED HELIX ARRAYS

[75] Inventor: Krishna Praba, Cherry Hill Township, Camden County, N.J.

[73] Assignee: General Electric Co., East Windsor, N.J.

[21] Appl. No.: 522,940

[22] Filed: May 14, 1990

[51] Int. Cl.[5] ..... H01Q 11/08

[52] U.S. Cl. ..... 343/895; 343/844

[58] Field of Search ..... 343/844, 853, 895, 846; 342/379

[56] References Cited

U.S. PATENT DOCUMENTS

| | | | |
|---|---|---|---|
| 3,182,330 | 5/1965 | Blume | 343/844 |
| 3,858,221 | 12/1974 | Harrison et al. | 343/844 |
| 4,101,901 | 7/1978 | Kommrusch | 343/853 |
| 4,213,132 | 7/1980 | Davidson | 343/814 |
| 4,349,825 | 9/1982 | Shmitka | 343/750 |
| 4,400,703 | 8/1983 | Shiokawa et al. | 343/895 |
| 4,427,984 | 1/1984 | Anderson | 343/764 |
| 4,460,895 | 7/1984 | Shmitka | 343/750 |
| 4,460,899 | 7/1984 | Schmidt et al. | 343/841 |

FOREIGN PATENT DOCUMENTS

| | | |
|---|---|---|
| 0132945 | 2/1985 | European Pat. Off. . |
| 0266925 | 5/1988 | European Pat. Off. . |
| 2050701 | 1/1981 | United Kingdom . |
| 2051486 | 1/1981 | United Kingdom . |

OTHER PUBLICATIONS

Durrani, "A Maritime Communications . . . Phased Arrays", Int'l Conf. on Satellite Systems . . . Surveillance, London, England, 13-15 Mar. 1973, pp. 71-74.

Wong et al., "Broadband Quasi-Taper Helical Antennas", IEEE Trans. on Antennas and Prop., vol. AP-27, No. 1, Jan. 1979, pp. 72-78.

"A Multipolarization Dual-Band Array", W. S. Gregorwich, Philco-Ford Corporation, Palo Alto, Calif., AP-D International Symposium, 1975.

*Primary Examiner*—Michael C. Wimer

*Attorney, Agent, or Firm*—W. H. Meise; C. A. Berard; S. A. Young

[57] ABSTRACT

Arrays of helical antennas are desired for operation at spaced-apart frequencies, such as 1.5 and 2.5 GHz. In order to reduce mutual coupling between the antenna elements of the lower-frequency array, they are spaced apart by more than λ. Grating lobes occur due to the spacing. The lengths of the lower-frequency helices are adjusted to move the nulls in their radiation patterns into congruence with the unwanted peaks of the array pattern, thereby suppressing the grating lobes. In order to reduce the total area of the combined arrays, the higher-frequency antennas of the second array are interleaved with the elements of the first array. At the higher frequency, the antenna elements of the second array are spaced apart even further, in terms of wavelength, than the elements of the first array, so mutual coupling of the antennas of the second array is reduced even more than in the first array. The number of turns of the helices of the second array are adjusted to bring nulls of the individual radiation patterns into coincidence with the unwanted grating lobes.

10 Claims, 8 Drawing Sheets

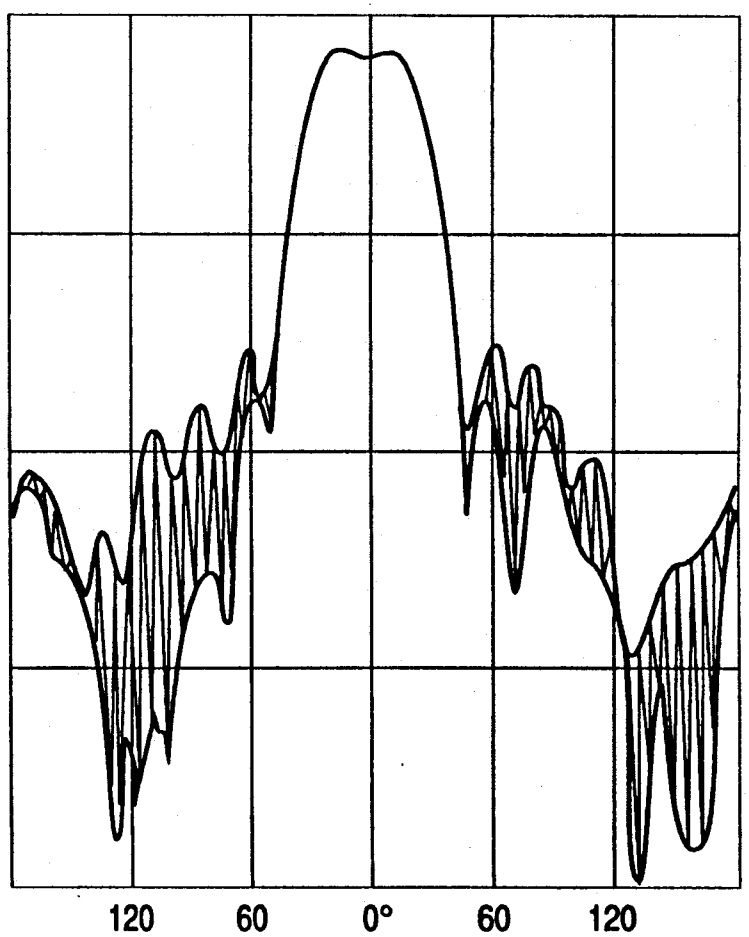
FIG. 2b
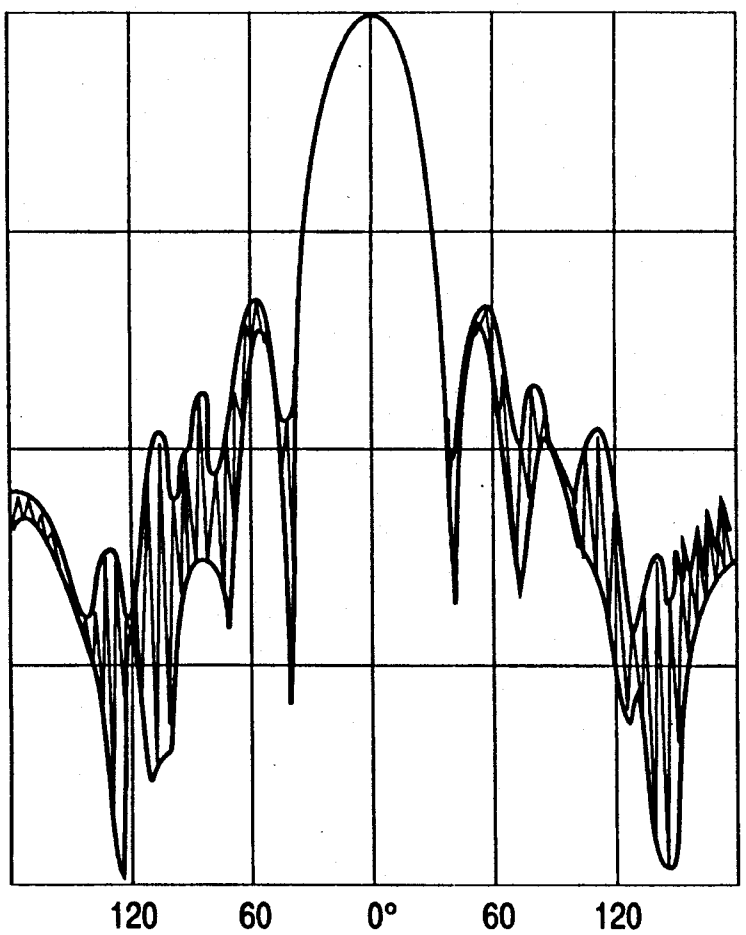
FIG. 2a
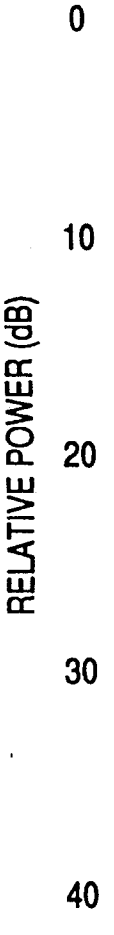

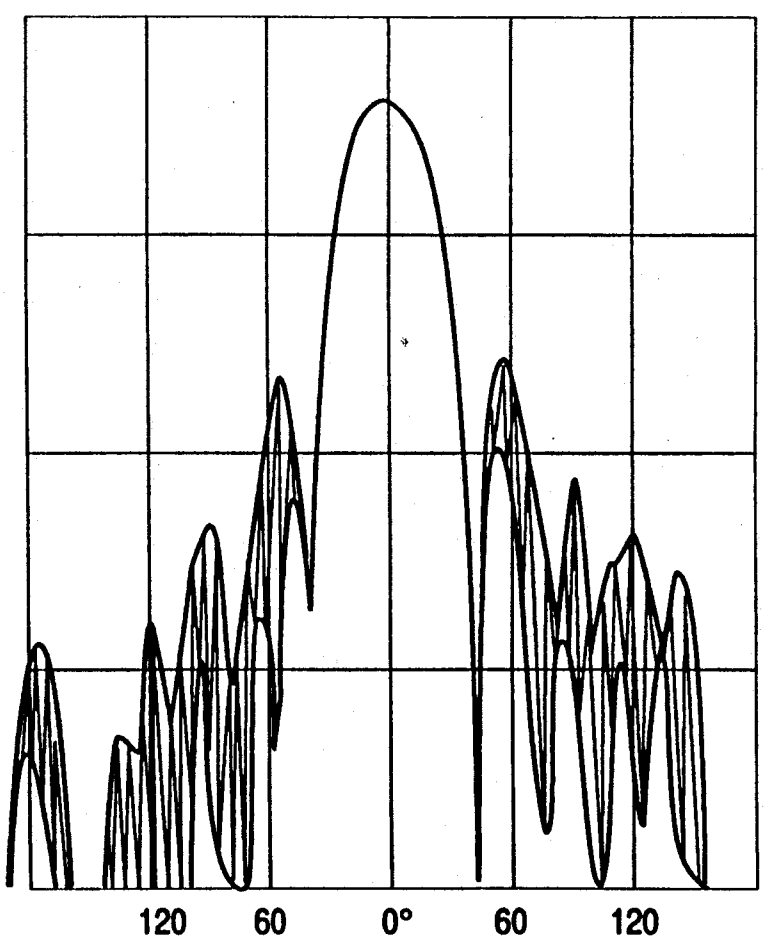
FIG. 4b
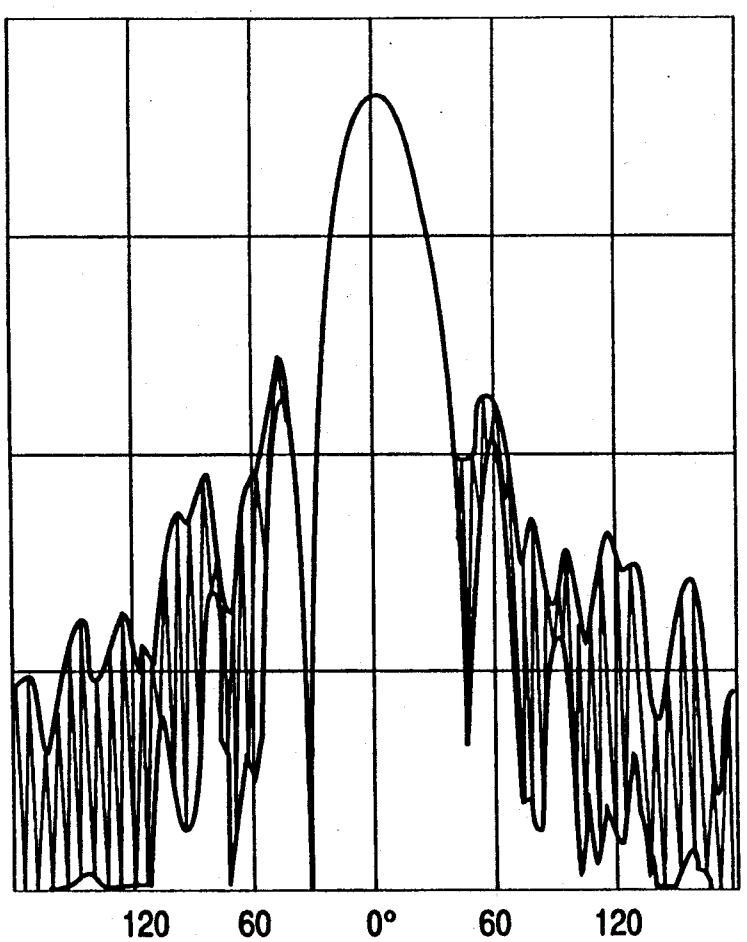
FIG. 4a
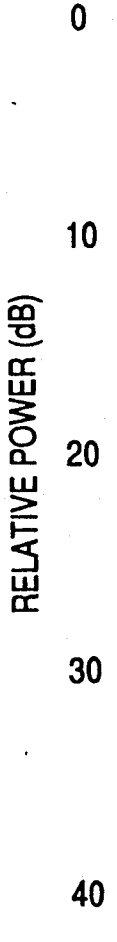

INTERLEAVED HELIX ARRAYS

BACKGROUND OF THE INVENTION

This invention relates to arrays of axial-mode helices in which the interstices between the helices of an array for one frequency are occupied by the helices of an array for a second frequency.

High gain antennas are widely useful for communication purposes and for radar or other sensing use. In general, high antenna gain is associated with high directivity, which in turn arises from a large radiating aperture. A common method for achieving a large radiating aperture is by the use of parabolic reflectors fed by a feed arrangement located at the focus of the parabolic reflector. Parabolic reflector type antennas are very effective, but for certain purposes may present to much of a wind load, and for scanning use they may have too much inertia. Also, parabolic antennas suffer from a problem of aperture blockage due to the structure required to support the feed, which may adversely affect the illumination of the aperture and thereby perturb the far-field radiation pattern.

Those skilled in the antenna art know that antennas are reciprocal transducers, which exhibit similar properties in both transmission and reception modes. For example, the antenna patterns for both transmission and reception are identical, and exhibit the same gain. For convenience of explanation, the explanations are often couched in terms of either transmission or reception of signals, with the other operation being understood. Thus, the term "aperture illumination" may pertain to either a transmission or reception mode of operation.

Modern systems find increasing use of antenna arrays for high gain use. The antenna array includes an array of ordinarily identical antennas or elements, each of which individually often has lower gain than the gain of the array. The antennas are arrayed together and fed with an amplitude and phase distribution which establishes the far-field radiation pattern. Since the phase and power applied to each element of the array can be individually controlled, the direction of the beam can be controlled by control of amplitude and phase. A salient advantage of the array antenna is the ability to scan the beam or beams electronically, without moving the mass of a reflector.

In general, the far-field radiation pattern of an array antenna is the product of the radiation pattern of one of the identical elements, multiplied by the radiation pattern of a corresponding array of isotropic sources. The design of array antennas can be difficult, because an array of isotropic sources in which the array spacing is one wavelength ($\lambda$) or greater includes a plurality of grating lobes with a magnitude equal to the main lobe. Ordinarily, such grating lobes are not desired, because when multiplied by the radiation pattern of the individual antenna element, they form sidelobes which allow jamming in a radar context, or perturb the sensing by simultaneously sensing in different directions. Also, such grating lobes represent directivity in unwanted directions which may reduce the gain in the desired direction. If the antennas are placed closer together in order to eliminate the possibility of grating lobes, mutual coupling effects between the antenna elements perturb the radiation patterns of the individual elements in ways which are difficult to predict. Thus, the design of array antennas is only partially amenable to analytic methods.

When array antennas are intended for use at plural frequencies, and grating lobes are not desired, it is ordinarily necessary to space the antenna elements closer than $\lambda$ at the highest desired frequency of operation, which results in a spacing which is even closer than that which would be required for a separation of $\lambda$ at a lower frequency. Consequently, when operation at plural frequencies is desired, mutual coupling effects between the antenna elements may be more severe than when single-frequency operation is contemplated. Thus, operation at plural frequencies is often accomplished by two or more completely separate antenna arrays. The size of two or more separate antenna arrays to achieve high gain may result in an unwieldy structure.

An improved antenna array arrangement is desired.

SUMMARY OF THE INVENTION

An antenna array arrangement adapted for operation at disparate relatively lower and higher frequencies includes a plurality of substantially identical axial mode helical first antennas adapted for operation at the lower frequency. Each of the first antennas, when operated at the lower frequency, produces a directive main beam along an axis, and also produces plural sidelobes angularly separated from each other and from the main beam by directivity nulls. A first arraying arrangement arrays together the first antennas to form a first array. In the first array, the axes of each of the first antennas are aligned in a direction which is broadside to the first array, with a selected spacing between the first antennas. The spacing between the first antennas is selected to be greater than or equal to one wavelength for thereby reducing mutual coupling among the first antennas. The selected spacing of the first antennas produces an array directivity pattern including plural directivity lobes of the grating-lobe type, only one of which is desired. The spacing is selected in conjunction with the first antennas so that at least some of the directivity sidelobes fall into the nulls of the patterns of the helical antennas. Another plurality of substantially identical axial-mode helical second antennas is adapted for operation at the higher frequency. Each of the second antennas when operated at the higher frequency produces a directive main beam along an axis and plural sidelobes which are separated from each other and from the main beam by directivity nulls. A second arraying arrangement arrays together the second antennas to form a second array, with the axes of each of the second antennas directed in a direction broadside to the second array. Each of the second antennas is located between adjacent ones of the first antennas. Thus, the second array is interleaved with the first array. The interantenna spacing of the second array in wavelengths is greater than that of the interantenna spacing of the first array because of its higher frequency. The interantenna spacing of the second array is such as to produce an array directivity pattern including plural directivity lobes and side lobes. The second antennas are selected so at least some of the directivity nulls of the second array fall into the nulls in the pattern of the second antennas. In a particular embodiment of the invention, the first antennas are of one hand of circular polarization, and a second antennas are of the other hand.

DESCRIPTION OF THE DRAWING

FIGS. 2*a* and 2*b*, referred to jointly as FIG. 2, represent the radiation pattern of one of the lower-frequency (larger) antennas of FIG. 1, alone and in the presence of one of the higher-frequency (smaller) antennas, respectively;

FIGS. 4*a* and 4*b*, referred to jointly as FIG. 4, represent the radiation patterns of one of the higher-frequency antennas of FIG. 1 in the presence of one of the lower-frequency antennas, taken in planes parallel to and perpendicular to, respectively, the plane of the array;

DESCRIPTION OF THE INVENTION

Figure 1:
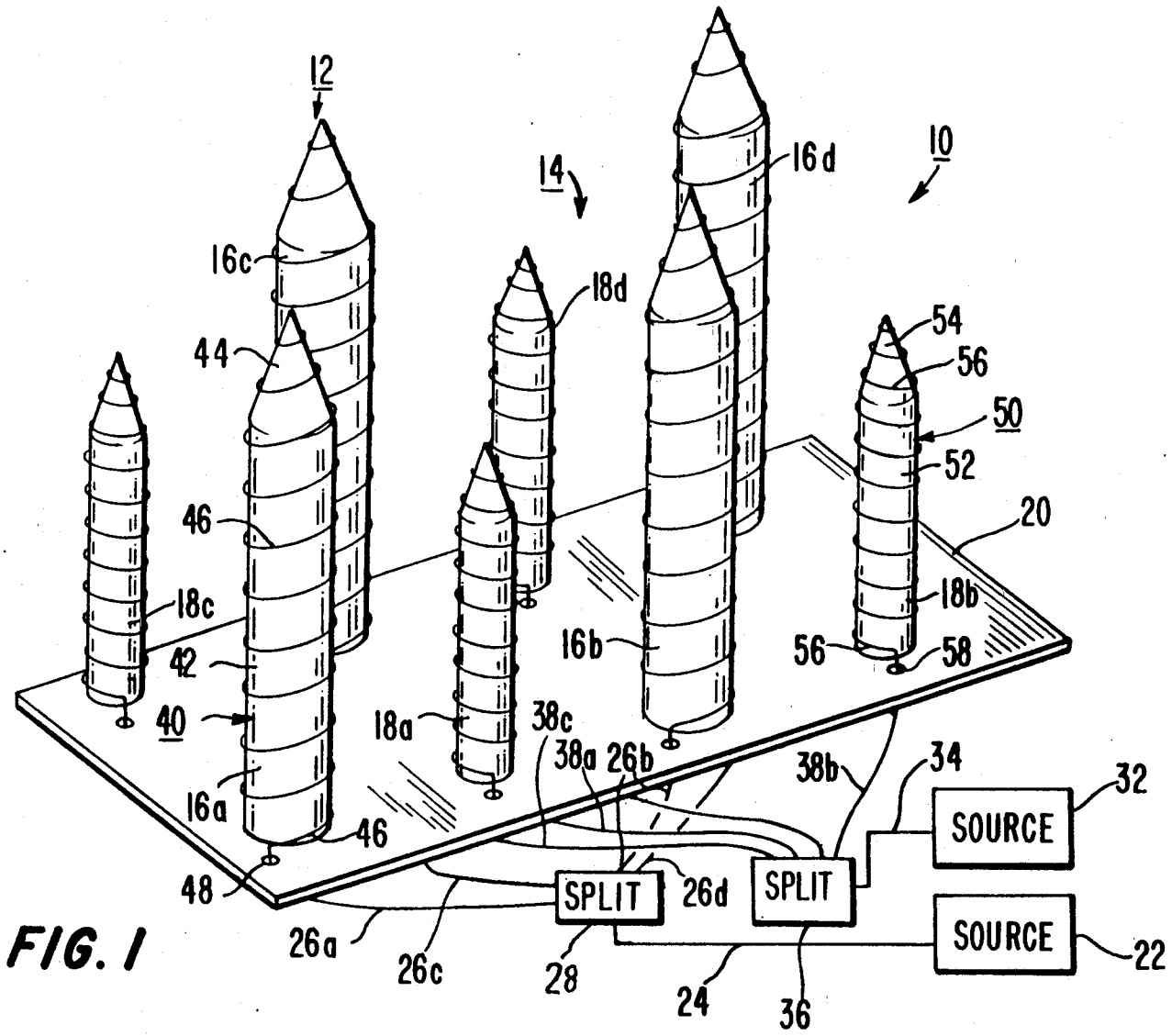
FIG. 1 is a perspective or isometric view of an array of helices adapted for operation at one frequency interleaved with a second array of helices adapted for operation at another frequency.

FIG. 1 is a perspective or isometric view of two interleaved antenna arrays. In FIG. 1, interleaved antenna array arrangement 10 includes a first array designated generally as 12 and a second array designated generally as 14. Array 12, as illustrated in FIG. 1, includes four relatively larger axial-mode helical antennas 16*a*, 16*b*, 16*c* and 16*d*. Array 14 includes four relatively smaller helical antennas 18*a*, 18*b*, 18*c*, and 18*d*. All helical antennas 16 are identical, and all antennas 18 are identical. Antennas 16 are intended for, and are optimized for operation at, a relatively lower frequency, whereas antennas 18 are intended for, and optimized for operation at, a relatively higher frequency. The antennas of arrays 12 and 14 are mounted upon and supported in place by a plate 20. As described below, plate 20 is conductive in order to coact with the antennas to form a directive structure. The array illustrated in FIG. 1 may be only a portion of a larger array (not illustrated), as well known in the art.

Also illustrated in FIG. 1 is a first signal source 22, which applies signal at a first frequency over a transmission line illustrated as 24 to a power divider or splitter 28, which divides the signal power into four portions, which are coupled to antennas 16*a*, 16*b*, 16*c* and 16*d* over transmission lines illustrated as 26*a*, 26*b*, 26*c* and 26*d*, respectively. Similarly, a second signal source 32 applies signal at a second frequency, higher than the first frequency, over a transmission line 34 to a power splitter 36, which divides the signal power into four positions, which are 15 coupled to antennas 18*a*, 18*b*, 18*c* and 18*d* over transmission lines illustrated as 38*a*, 38*b*, 38*c* and 38*d*, respectively.

As illustrated in FIG. 1, antenna 16*a*, taken as being typical, includes a dielectric support member 40 which includes a cylindrical portion 42 affixed to mounting plate 20. A conical portion 44 of dielectric support 40 surmounts cylindrical portion 42. A single wire conductor 46 is wound about dielectric support 40 in a clockwise direction as viewed from conical end 44. At the bottom of antenna 16*a*, namely at the junction of dielectric support 40 with mounting plate 20, conductor 46 is connected by way of a coaxial through connector 48 to transmission line 26*a*. Those skilled in the art will recognize the structure of antenna 16*a* as defining, together with conductive mounting plate 20, an axial mode helical antenna. As mentioned, antennas 16*b*, 16*c* and 16*d* are identical to antenna 16*a*, except that they are connected to different transmission lines.

Antenna 18*b* is taken as typical of the smaller antennas. As illustrated in FIG. 1, antenna 18*b* includes a dielectric support member 50 including a cylindrical portion 52 affixed to mounting plate 20. A conical portion 54 of dielectric support 50 surmounts cylindrical portion 52. A single conductor 56 is wound about dielectric support 50 in a counterclockwise direction as viewed from conical end 54. At the bottom of antenna 16*a*, namely at the junction of dielectric support 50 with mounting plate 20, conductor 56 is connected by way of a coaxial through connector 58 to transmission line 38*b*. Those skilled in the art will recognize the structure of antenna 18*b* as defining, together with conductive mounting plate 20, an axial mode helical antenna for operation at a higher frequency than antenna 16*a*. As mentioned above, antennas 18*a*, 18*c* and 18*d* are identical to antenna 18*b*, except that they are connected to other transmission lines.

Axial mode helical antennas such as antennas 16 or 18 of FIG. 1, within certain frequency ranges, have a directive radiation pattern with a pronounced main lobe and relatively smaller sidelobes. Those skilled in the art know that such antennas are circularly or elliptically polarized, with the hand of circular polarization being dependent upon the direction in which the windings are wound about the supports in FIG. 1.

FIG. 2*a* is a circular polarization or axial-ratio plot of the far-field radiation pattern of an antenna such as antenna 16*a* of FIG. 1, measured alone on a mounting plate. FIG. 2*a* is plotted in decibels (dB) along the ordinate and in degrees along the abscissa, and represents the response in a single plane in which the axis (not illustrated) of antenna 16*a* of FIG. 1 lies. The plot of FIG. 2*a* was made at 1.668 GHz on a helix 16*a* having the following characteristics. The total antenna height was 19.05 inches. The dielectric support had a diameter of 2.432 inches and a circumference of 7.638 inches. The conical portion of the dielectric support had an included angle of 15°. A total wire length of about 72 inches was wound in ten turns, eight turns of which were on the cylindrical portion and two turns of which were on the conical portion. The eight turns on the cylindrical portion had a total wire length of 62.987 inches, while the conical portion had a length of 7.873 inches. The wire pitch angle was 14.002°, which provided a turn-to-turn spacing of 1.905 inches. The relative phase velocity was established to be 0.793, and the polarization was right circular. As illustrated in FIG. 2*a*, the axial ratio or circularity on-axis (at 0°) is a small fraction of a dB. The circularity is good over the entire main beam, extending to about ±30° from the axis, at which angle the first nulls occur. The first sidelobes are approximately 14 dB below the main lobe, and have an axial ratio in the region of 1 dB. Beyond 50° from the beam peak, the sidelobe level decreases, and the axial ratio degrades toward 10 dB, assumed to be a linear condition for these purposes. Deep nulls occur for some polarizations.

FIG. 2*b* represents the same helix as that of FIG. 2*a*, in the presence of a helix such as a helix 18 of FIG. 1, spaced by about at 4.5 inches, which is approximately 0.64 λ at 1.668 GHz, corresponding to a spacing of 1.28λ between antennas 16 of FIG. 1. As illustrated in FIG. 2*b*, the main lobe is somewhat broader than when the antenna is alone (FIG. 2*a*), with slightly less gain, but the sidelobes are still approximately 14 dB below the main lobe, and nulls occur for some polarizations at angles greater than about 50° off-axis.

Figure 3:
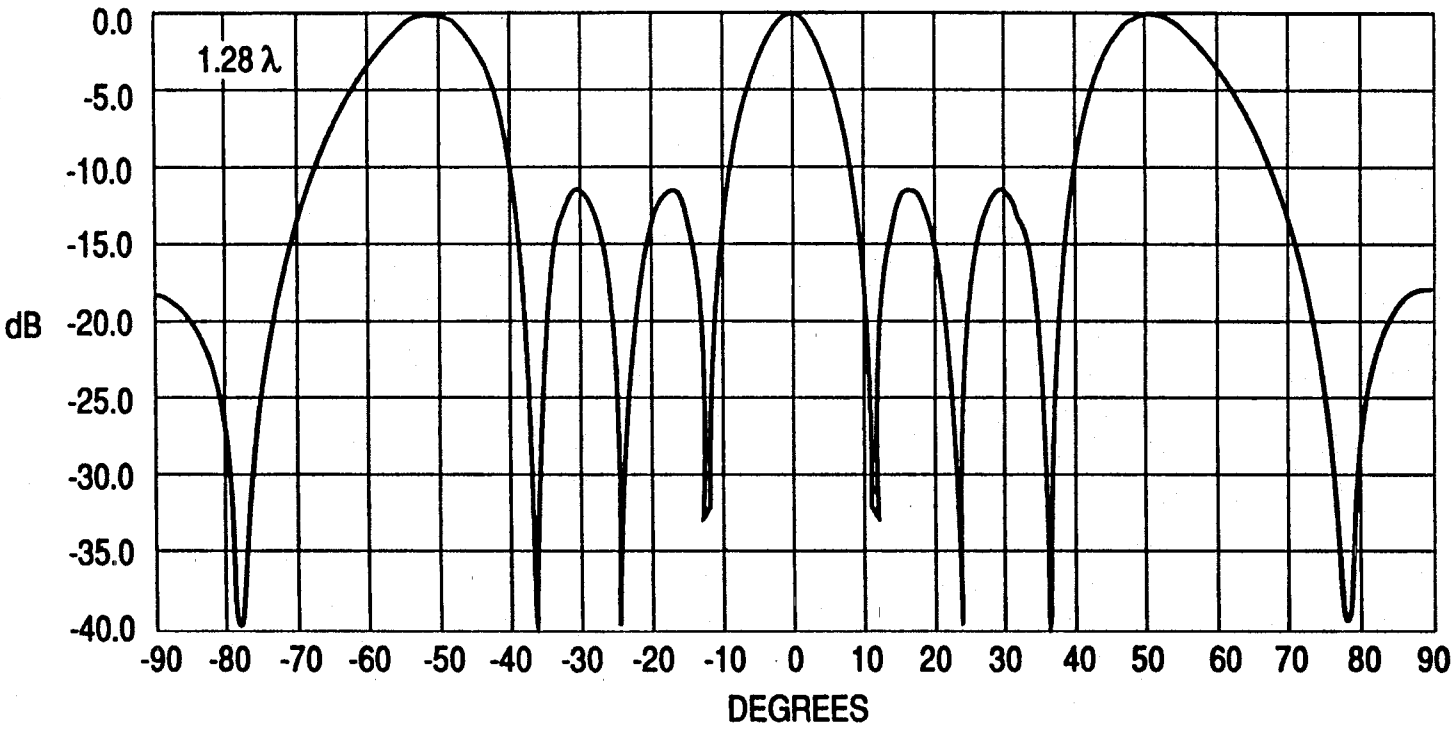
FIG. 3 illustrates the principal plane directivity pattern of a linear array of four isotropic antennas spaced by 1.28λ.

FIG. 3 is a plot of the grating lobes in dB versus angle in degrees for an array of four isotropic sources spaced by 1.28λ, to show where the grating lobe peaks tend to occur for operation at about 1.68 GHz with an element-to-element spacing of antennas 16 of nine inches or 1.28λ: As illustrated in FIG. 3, the unwanted grating lobe peaks occur at about ±50°.

FIGS. 4*a* and 4*b* are plots of the response at 2.5 GHz of one of antennas 18 of FIG. 1 in the presence of one of antennas 16 of FIG. 1 as described above, both mounted 4.5 inches apart (0.945λ, corresponding to an interelement spacing of 1.89λ of antennas 18) on a mounting plate similar to that of FIG. 20. For the plots of FIGS. 4*a* and 4*b*, antenna 18 had the following characteristics. The total antenna height was 12.410 inches. Support 50 had a diameter of 1.711 inches and a circumference of 5.375 inches, and a cone angle of 15°. A total wire length of about 51 inches was wound in a total of ten turns about support 50, with eight turns being wound about cylindrical portion 52 of the support, and two turns being wound about conical portion 54. The length of wire wound about the cylindrical portion was 44.131 inches, and the length of wire wound about the cylindrical portion was 7.122 inches. The turn length in the cylindrical portion was 5.516 inches. The pitch angle of the windings was 13.001°, and the turn-to-turn spacing was 1.241 inches.

The plot of FIG. 4*a* is an axial ratio plot as described earlier, taken in a plane including both helices. The plot was made at 2.5 GHz. The plot has a smooth main lobe with low axial ratio, and sidelobes about 15 dB down spaced about 55° from the main beam and separated therefrom by nulls. The nulls are mainly linearly polarized. FIG. 4*b* is a similar plot made in a plane perpendicular to that of FIG. 4*a*. Comparison of the plots of FIGS. 4*a* and 4*b* shows that they are quite similar.

As so far described, corresponding antennas of each array are spaced by an amount greater than λ, which significantly reduces mutual coupling between like antenna elements. Grating lobes occur as a result of the large spacing. The positions of the nulls of the helical antennas can be adjusted by selecting the number of helix turns to position the nulls directly at the peaks of the grating lobes of the array pattern. The nulls at the radiation patterns of the helical antennas move closer to the main lobe as the helix gets longer. Consequently, it is only necessary to lengthen or shorten the helices to select the appropriate position to the nulls to thereby substantially reduce the magnitudes of the peaks of the grating lobes. This has little effect on the gain of the array, as the array gain is principally established by the array factor and only slightly by the gain of the individual antennas. The lengths of the helices are selected to set the null position at the angle which suppresses grating lobe peaks. The resulting array exhibits high directive gain, and is relatively easy to design analytically because of the reduced mutual coupling. It has the further advantage of occupying less space than would be occupied by two separate, independent arrays selected to perform the same function, especially considering that each separate array would have to be larger to achieve the same directive gain because of the spacing being less than λ.

Figure 5:
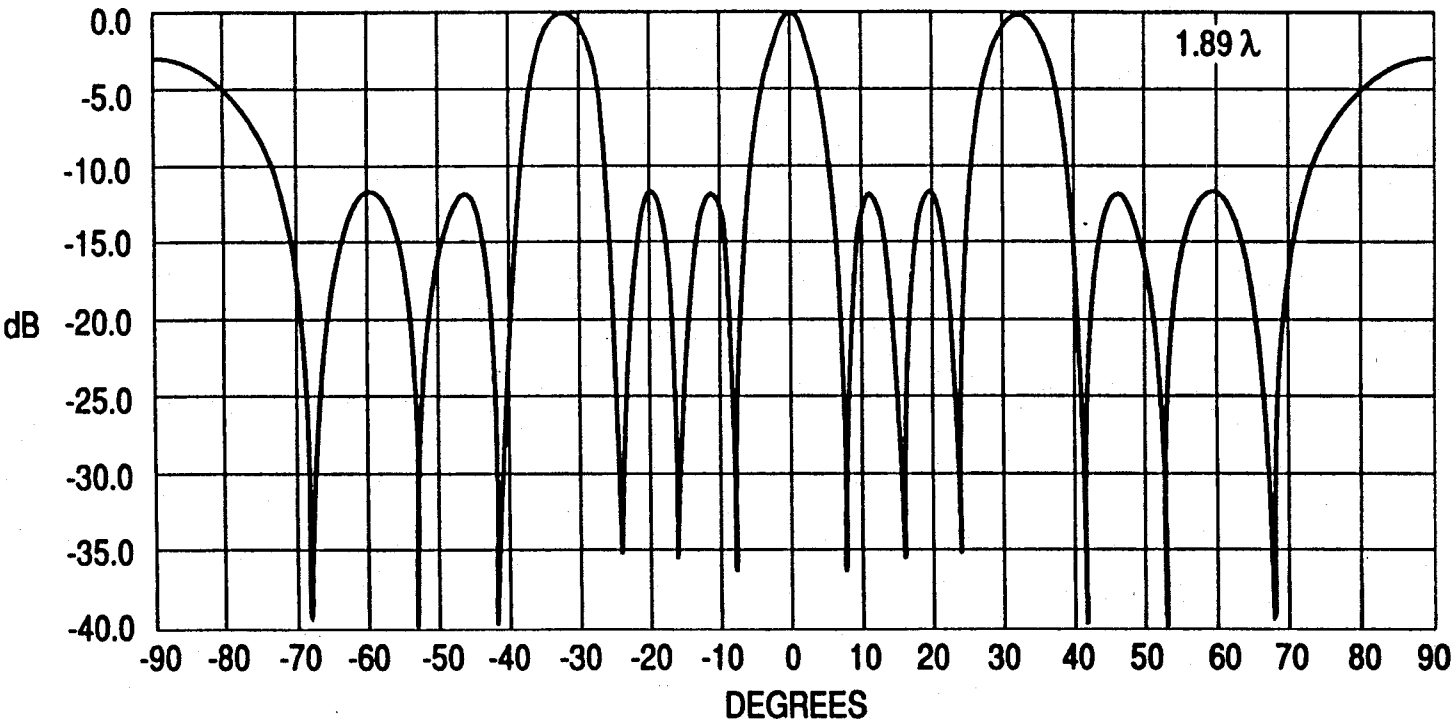
FIG. 5 illustrates the principal plane directivity pattern of an array of four isotropic antennas spaced by 1.89λ.

FIG. 5 is a plot of grating lobes produced in the far field by a linear array of four isotropic sources spaced by 1.89λ, corresponding to the spacing of the smaller helices 18 of FIG. 1. As illustrated in FIG. 5, the peaks of the unwanted grating lobes occur at about ±32°.

Figure 6:
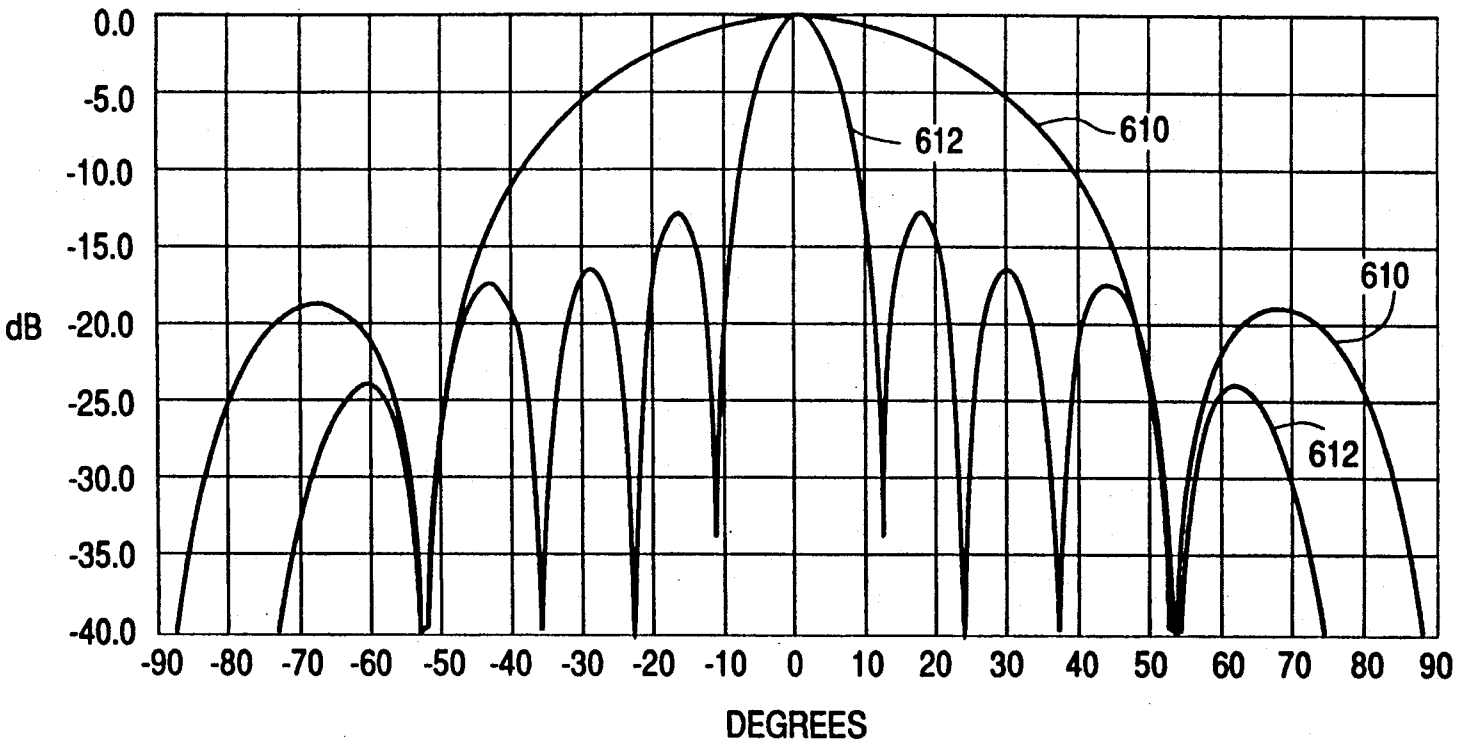
FIG. 6 illustrates calculated plots of the radiation patterns of a single helix alone and of an array of four such helices spaced by 1.28λ.
Figure 7:
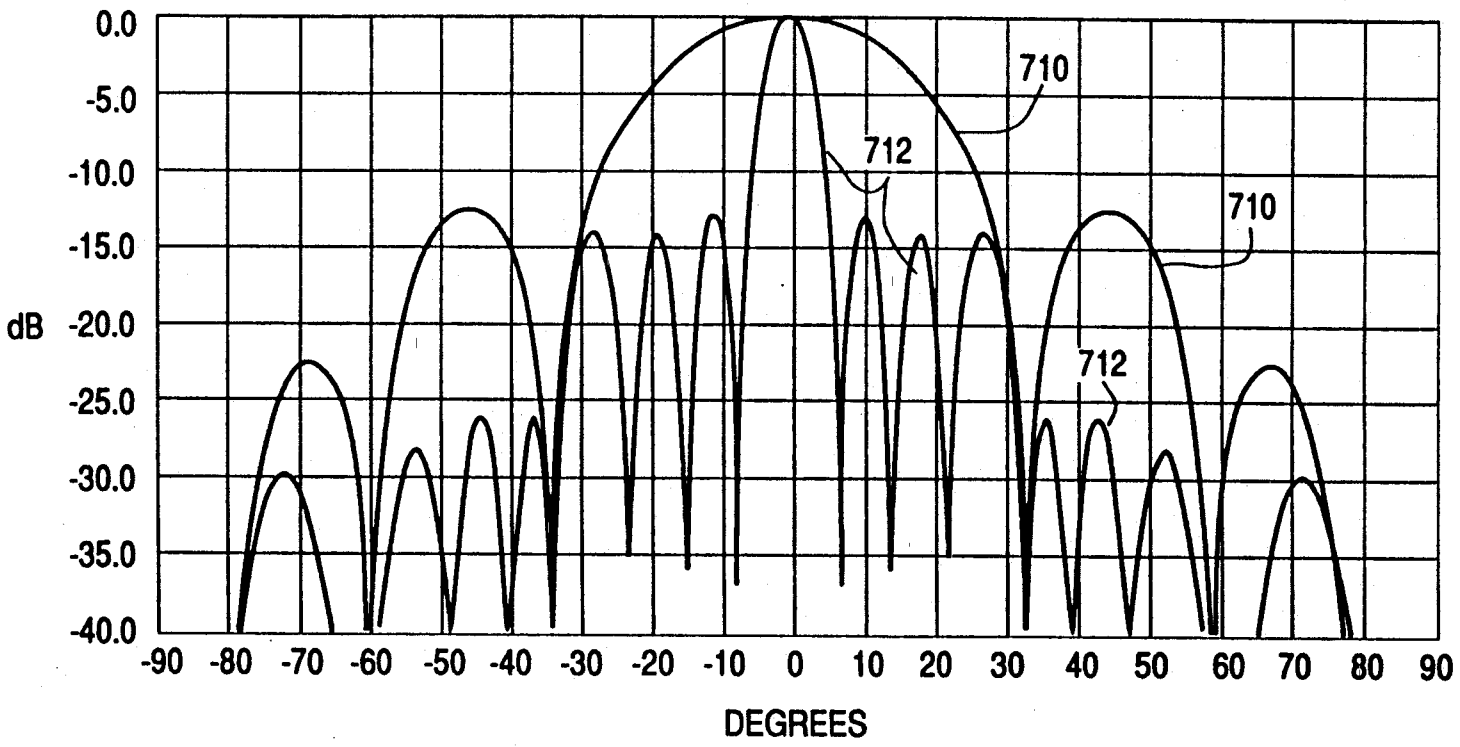
FIG. 7 illustrates calculated plots of the radiation patterns of a single helix alone and of an array of four such helices spaced by 1.89λ.

FIG. 6 plots as 610 and 612 the calculated radiation pattern of a six-turn helix alone, and of an array of four such helices spaced 1.28λ, respectively. As illustrated in FIG. 6, nulls in helix pattern 610 occur at about ±52°, corresponding to the peak of the unwanted grating lobes illustrated in FIG. 3. The superposition results in suppression of the peak portions of the grating lobe. FIG. 7 plots as 710 and 712 the calculated radiation pattern of a 13-turn helix and of an array of four such helices spaced 1.89λ, respectively. As illustrated in FIG. 7, nulls in helix pattern 710 occur at about ±32°, corresponding to the peaks of the unwanted grating lobes, so the combined pattern 712 suppresses the peak values of the grating lobes. The suppression of the unwanted grating lobes tends to increase the gain on-axis or on the desired lobe.

Figure 8:
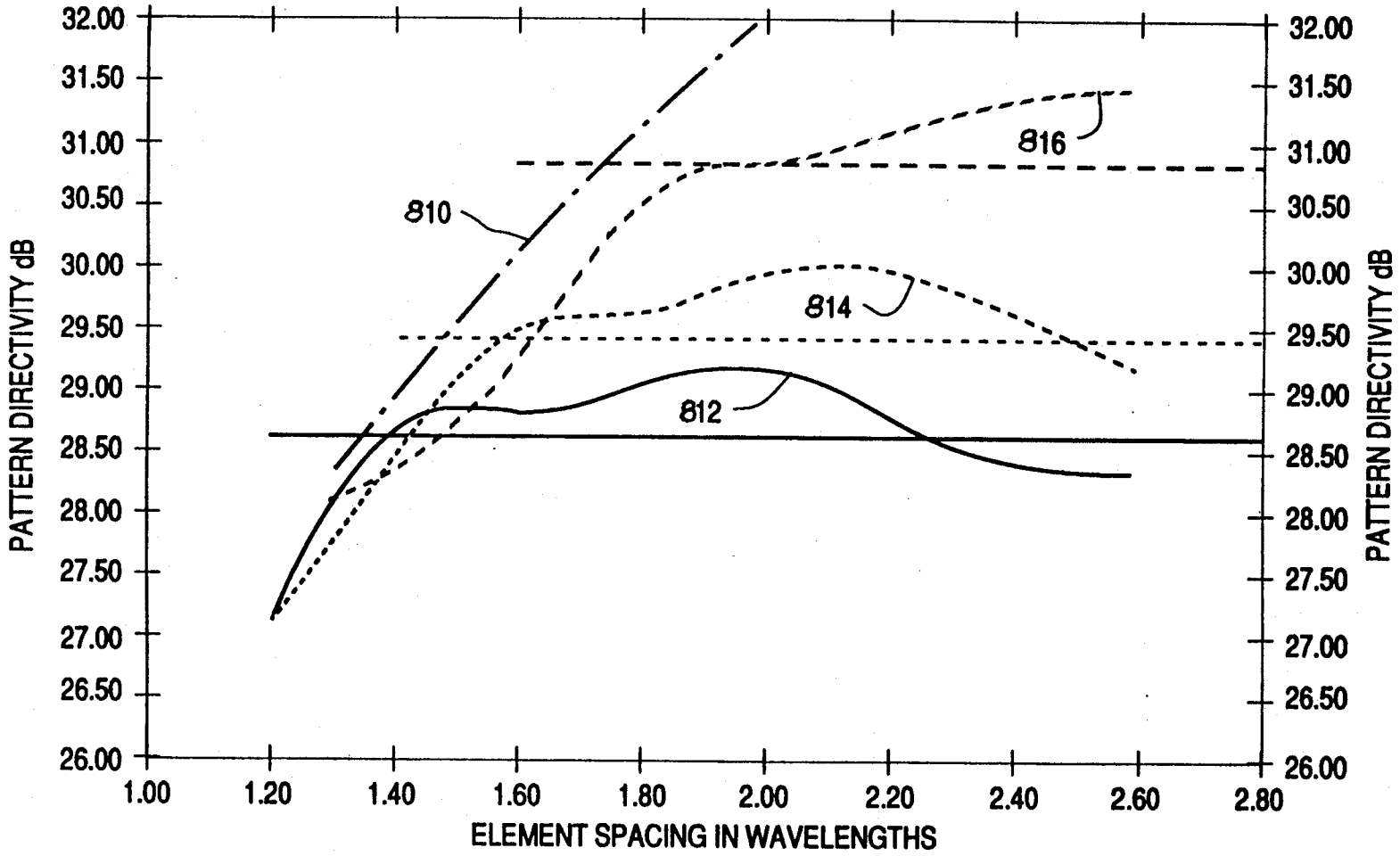
FIG. 8 plots directivity versus element spacing in wavelengths for certain arrays including arrays of helical antennas.

FIG. 8 plots directivity versus element spacing for several arrays. In FIG. 8, dot-dash line 810 represents the theoretical aperture directivity of a uniformly illuminated planar 4×8 array including 32 isotropic elements. As illustrated in FIG. 8, the directive gain of such an array ranges from about 28.5 dB to 32 dB as the element spacing increases from about 1.35 to 2λ. The directive gain is not the same as aperture gain, in part because of the grating lobes of such an array.

In FIG. 8, solid line 812, dotted line 814 and dash line 816 represent the directive gain of a corresponding array of eight, ten and thirteen-turn helices, respectively. Thus, dotted line 814 represents the directive gain of a 4×8 array of helices such as that described in conjunction with FIG. 1 with 10 turns, without interleaving the helices of the array with another array, for element-to-element spacings ranging from 1.2 to 2.6 λ. As illustrated in FIG. 8, plot 812 (eight turn helices) has a peak directive gain at a spacing about 2λ. Dash-line plot 816 represents the gain of a 4×8 array of 15 turn helices.

Other embodiments of the invention will be apparent to those skilled in the art. For example, mounting plate 20 of FIG. 1 need not be conductive if the antennas do not depend on the presence of a ground plane, as would be the case, for example, if the antennas were bifilar helices fed from the top ends. The antenna elements, illustrated in FIG. 1 as including dielectric support numbers, may instead have self-supporting conductors to reduce dielectric losses, cost, weight, or for other reasons As described, the antennas of each array are fed with equal amplitude and phase signals, to thereby produce a broadside beam, but scanning may be accomplished by adjusting the relative amplitudes and phases of the signals applied to the individual antennas. While two interleaved arrays have been described, three or more arrays of different frequencies could be interleaved in a similar manner. While the interleaved arrays as so far described are coextensive, i.e., have substantially equal overall dimensions, one array could be smaller than another array with which it is interleaved.

What is claimed is:

1. An antenna array arrangement adapted for operation at disparate relatively lower and higher frequencies, comprising:

a plurality of substantially identical axial-mode helical first antennas adapted for operation at said lower frequency, each one of said first antennas when operated at said lower frequency producing a directive main beam along an axis associated with said one of said first antennas, said one of said first antennas also producing plural sidelobes, said plural sidelobes of each one of said first antennas being angularly separated from others of said plural sidelobes of said one of said first antennas and from said main beam of said one of said first antennas by directivity nulls;

first arraying means for arraying said plurality of first antennas together in an array direction to form a first array, with said axis of each of said first antennas directed in a direction broadside to said array direction of said first array, with a selected interantenna spacing between each of said first antennas and the adjacent one of said antennas, said selected interantenna spacing being greater than or equal to one wavelength at said relatively lower frequency for thereby reducing mutual coupling among said first antennas so arrayed, said selected spacing being such as to produce an array directivity pattern including plural directivity lobes, at least one of which is desired, said selected spacing of said first antennas being selected in conjunction with said angular separation of said plural sidelobes of said first antennas so that at least one of said plural directivity lobes of said array directivity pattern, other than said one which is desired, makes the same angle with said direction broadside to said array direction of said first array that some of said directivity nulls of said first antennas make with said axes associated with said first antennas, whereby at least said one of said directivity lobes tends to be canceled;

a further plurality of substantially identical axial-mode helical second antennas, each of which is physically different from one of said first antennas, said second antennas being adapted for operation at said higher frequency, each one of said second antennas when operated at said higher frequency producing a directive main beam along an axis associated with said one of said second antennas, said one of said second antennas also producing plural sidelobes, said plural sidelobes of each one of said second antennas being angularly separated from others of said plural sidelobes of said one of said second antennas and from said main beam of said one of said second antennas by directivity nulls;

second arraying means for arraying said further plurality of second antennas together in said array direction to form a second array, wit said axis of each of said second antennas directed in a direction broadside to said array direction of said second array, with each of said second antennas located between adjacent ones of said first antennas, whereby said second array is interleaved with said first array, the interantenna spacing of said second antennas in said second array in wavelengths at said relatively higher frequency being greater than that of the interantenna spacing of said first antennas in said first array as a result of said higher frequency, said interantenna spacing of said second antennas of said second array being such as to produce an array directivity pattern including plural directivity lobes, at least one of which is desired, said spacing of said second antennas being selected in conjunction with said angular separation of said plural sidelobes of said second antennas so that at least some of said directivity nulls of said second antennas make the same angle with said axes of said second antennas as at least one of said plural directivity lobes of said second array makes with said direction broadside to said second array, whereby at least one of said plural directivity lobes tends to be canceled.

2. An arrangement according to claim 1 wherein each of said second antennas which lies between two adjacent first antennas is equidistant therefrom.

3. An arrangement according to claim 1 wherein each of said first antennas of said first array is fed in the same phase.

4. An arrangement according to claim 1 wherein each of said second antennas of said second array is fed in the same phase.

5. An arrangement according to claim 1 wherein the helices of said helical antennas of one of said first and second arrays are wound to provide right-hand circular polarization, and the helices of said helical antennas of the other of said first and second array are wound to provide left-hand circular polarization to thereby reduce mutual coupling between said first and second antennas.

6. An arrangement according to claim 1 wherein said first array is one of a line array and a planar array.

7. An arrangement according to claim 1, wherein said arrangement further includes a ground plane parallel with the plane of said array, and wherein said helical antennas are monofilar.

8. An arrangement according to claim 1, wherein said axial-mode helical first and second antennas each include a constant-diameter helical winding and a terminating winding including a conical helical winding.

9. An arrangement according to claim 1, wherein each of said first antennas has a winding pitch angle of about 14 degrees, and each of said second antennas has a winding pitch angle of about 13 degrees.

10. An antenna array arrangement adapted for operation at disparate relatively lower and higher frequencies, comprising:

a plurality of substantially identical axial-mode helical first antennas adapted for operation at said lower frequency;

first arraying means for arraying said plurality of first antennas together in an array direction to form a first array, with a selected interantenna spacing between each of said first antennas and the adjacent one of said antennas;

a further plurality of substantially identical axial-mode helical second antennas, each of which is physically different from one of said first antennas, said second antennas being adapted for operation at said higher frequency, each one of said second antennas when operated at said higher frequency producing a directive main beam along an axis associated with said one of said second antennas, each one of said second antennas when operated at said higher frequency also producing plural sidelobes, said plural sidelobes of each one of said second antennas being angularly separated, by directivity nulls, from others of said plural sidelobes of said one of said second antennas and from said main beam of said one of said second antennas;

second arraying means for arraying said further plurality of second antennas together in said array direction to form a second array, with said axis of each of said second antennas directed in a direction broadside to said array direction of said second array, with each of said second antennas located between adjacent ones of said first antennas, with the interantenna spacing of said second antennas in said second array at said relatively higher frequency being greater than one wavelength, said interantenna spacing of said second antennas of said second array being such as to produce an array directivity pattern including plural directivity lobes, at least one of which is desired, said spacing of said second antennas being selected in conjunction with said angular separation of said plural sidelobes of said second antennas so that at least some of said directivity nulls of said second antennas make the same angle with said axes of said second antennas as at least one of said plural directivity lobes of said second array makes with said direction broadside to said second array, whereby at least one of said plural directivity lobes tends to be canceled.

* * * * *